US007032936B2

(12) United States Patent
Promutico

(10) Patent No.: US 7,032,936 B2
(45) Date of Patent: Apr. 25, 2006

(54) DOOR LOCK DEVICE FOR A DOMESTIC ELECTRICAL APPLIANCE

(75) Inventor: Fabrizio Promutico, Alatri (IT)

(73) Assignee: Bitron S.p.A., Nichelino (IT)

( * ) Notice: Subject to any disclaimer, the term of this patent is extended or adjusted under 35 U.S.C. 154(b) by 0 days.

(21) Appl. No.: 10/258,119

(22) PCT Filed: Apr. 20, 2001

(86) PCT No.: PCT/EP01/04517

§ 371 (c)(1),
(2), (4) Date: May 5, 2003

(87) PCT Pub. No.: WO01/81696

PCT Pub. Date: Nov. 1, 2001

(65) Prior Publication Data

US 2003/0160461 A1 Aug. 28, 2003

(30) Foreign Application Priority Data

Apr. 21, 2000 (IT) ..... TO2000A0383

(51) Int. Cl.
*E05C 19/10* (2006.01)

(52) U.S. Cl. ..... 292/95; 292/341.17; 292/DIG. 69

(58) Field of Classification Search ..... 292/95, 292/116, 117, 213, 216, DIG. 69, 341.17
See application file for complete search history.

(56) References Cited

U.S. PATENT DOCUMENTS

| | | | | |
|---|---|---|---|---|
| 5,419,305 A * | 5/1995 | Hanley | 126/197 |
| 5,477,030 A * | 12/1995 | Buckshaw et al. | 219/413 |
| 5,493,099 A * | 2/1996 | McWilliams, III | 219/413 |
| 5,517,006 A * | 5/1996 | Fredriksson et al. | 219/723 |
| 6,402,208 B1 * | 6/2002 | Shimizu | 292/123 |
| 6,474,702 B1 * | 11/2002 | Malone et al. | 292/97 |

FOREIGN PATENT DOCUMENTS

| | | |
|---|---|---|
| CH | 253 219 A | 2/1948 |
| DE | 195 34 844 A | 10/1999 |

* cited by examiner

*Primary Examiner*—Gary Estremsky
(74) *Attorney, Agent, or Firm*—Sughrue Mion, PLLC

(57) ABSTRACT

The device comprises a hook (2) connected to the door (5) and a support structure (1) in which is defined an aperture (4) for the introduction of the hook (2) and in which are mounted: a rotatable member (6) biased by a spring (12) and operable to retain a hook in a closure position of the door (5) and to release this hook (2); and a control device (14-16) including a pawl (15). When, with the door (5) closed, a force is applied to the hook (2) in the direction such as to open the door (5), the rotatable member (6) is initially free to turn, against the action of the spring (11), with respect to an auxiliary body (9), to a position in which the rotatable member (6) releases the auxiliary body (9) from the pawl (15, 19), and then to turn, together with the auxiliary body (9) and under the action of the spring (11), to release the hook (2).

6 Claims, 7 Drawing Sheets

DOOR LOCK DEVICE FOR A DOMESTIC ELECTRICAL APPLIANCE

This is a National stage entry under 35 U.S.C. § 371 of Application No. PCT/EP01/04517 filed Apr. 20, 2001; the disclosure of which is incorporated herein by reference.

BACKGROUND OF THE INVENTION

The present invention relates to a door lock device for a domestic electrical appliance, in particular for washing machines and/or tumble dryers, of the type defined in the introductory part of the annexed claim 1.

SUMMARY OF THE INVENTION

One object of the invention is to provide a door lock of this type which is of reliable operation, a simplified structure and a small size.

These and other objects are achieved according to the invention with a door lock device, the essential characteristics of which are defined in the annexed claim 1.

BRIEF DESCRIPTION OF THE DRAWINGS

Further characteristics and advantages of the invention will become apparent from the following detailed description given purely by way of non-limitative example, with reference to the attached drawings, in which.

DETAILED DESCRIPTION OF THE INVENTION

Figure 1:
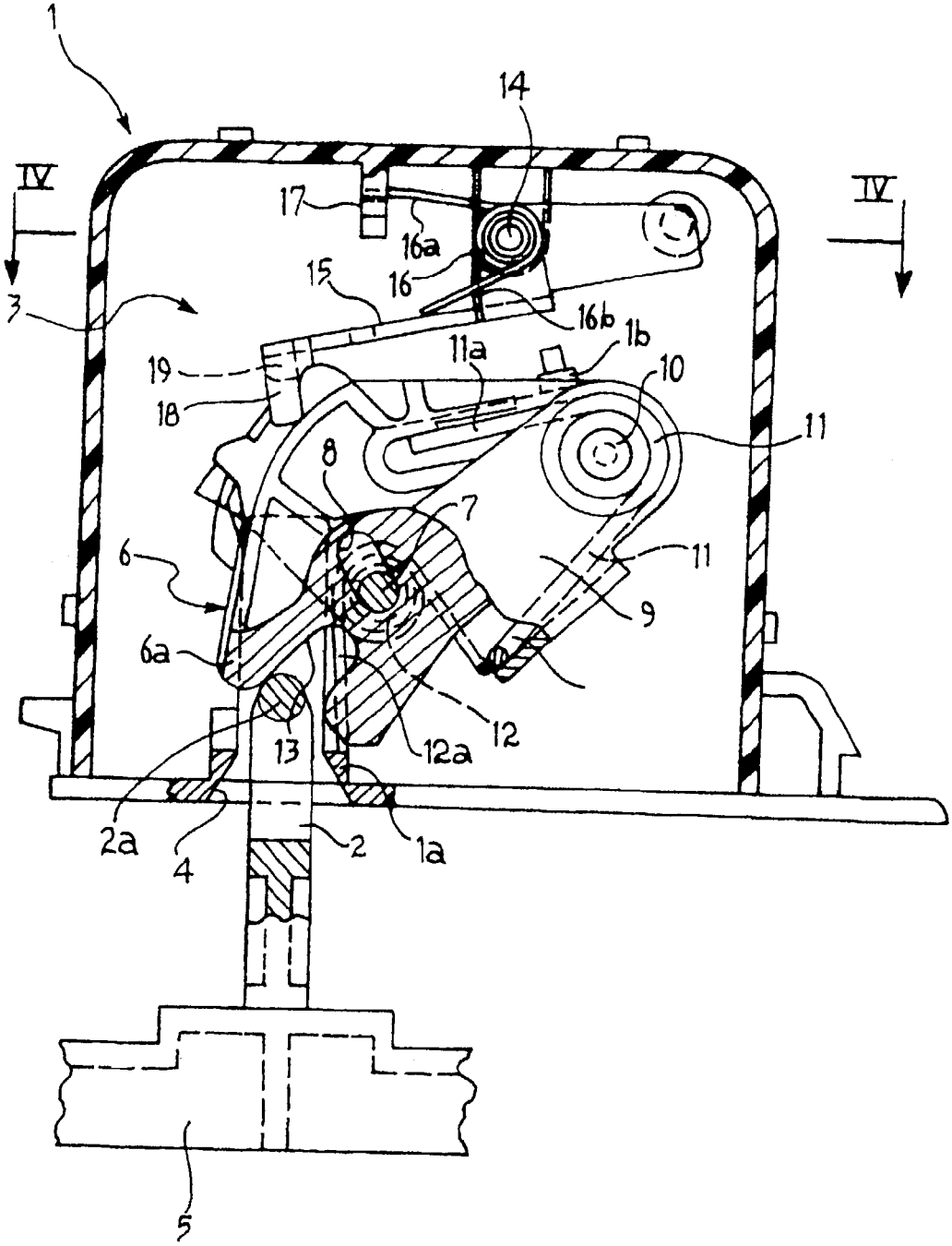
FIG. 1 is a partially sectioned side view of a door lock device according to the invention, shown in the configuration with the door still open.

With reference to FIG. 1, the illustrated exemplary embodiment of a door lock device according to the invention comprises a support structure 1 within which the mechanism generally indicated 3 is mounted.

The support structure 1 is essentially in the form of a rectangular container with an aperture 4 through which a hook 2 connected to door 5 of the domestic electrical appliance can be introduced.

The door lock device is intended to be mounted on the domestic electrical appliance at the opening with which the door 5 is associated.

The internal mechanism 3 within the structure 1 comprises a cam member 6 which is rotatably mounted about a pin 7 which is stationary with respect to the support structure 1. In particular, the pin 7 is engaged in a curvilinear slot-like opening 8 of the cam member 6.

Figure 3:
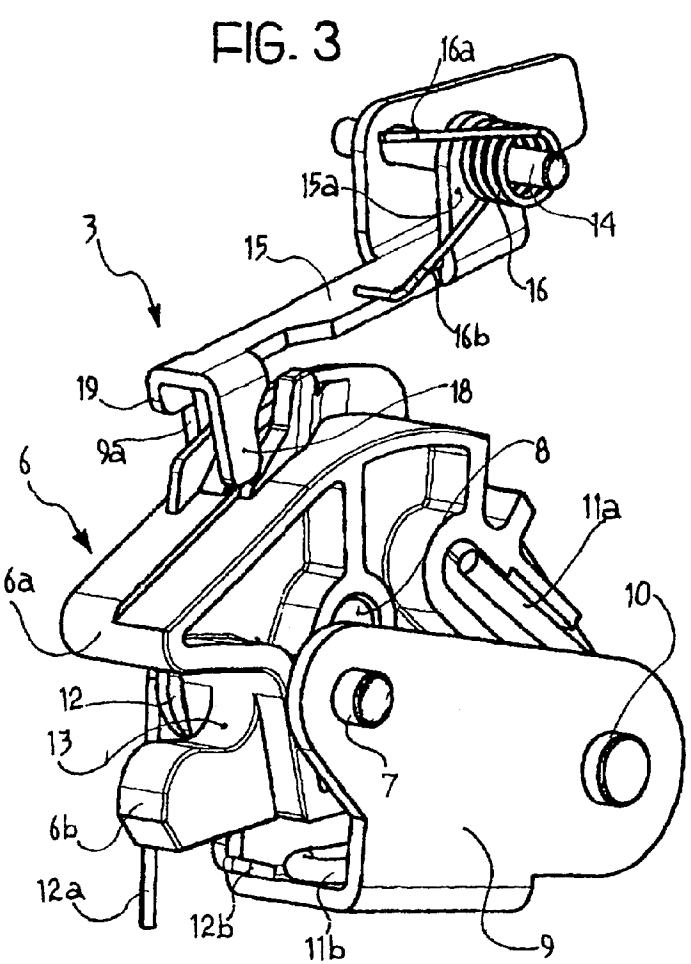
FIGS. 2 and 3 are perspective views of the internal mechanism of the door lock device shown in FIG. 1.
Figure 2:
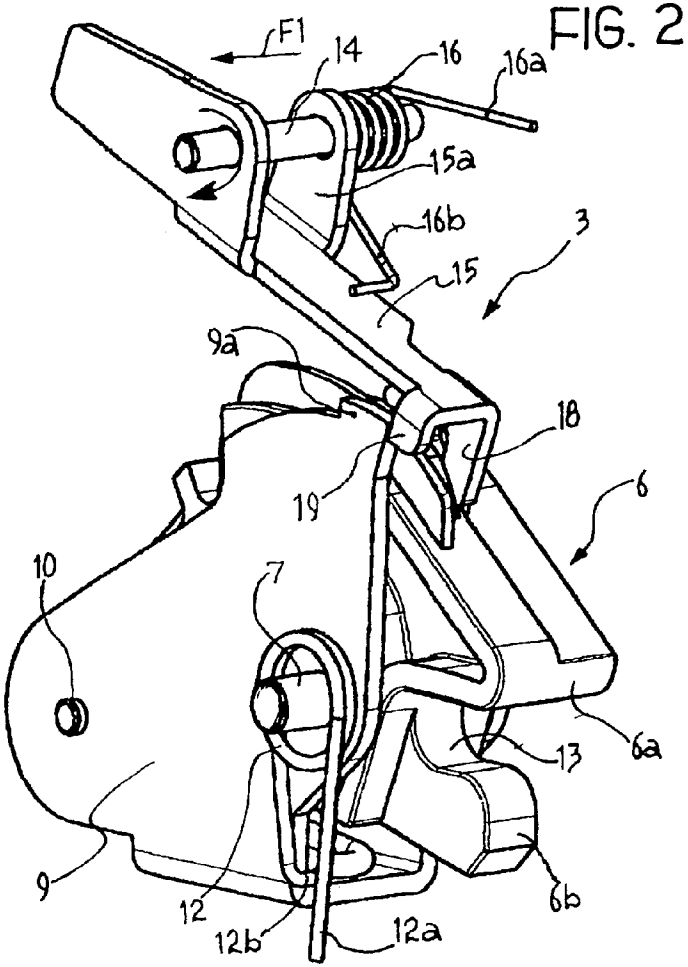
Figure 4:
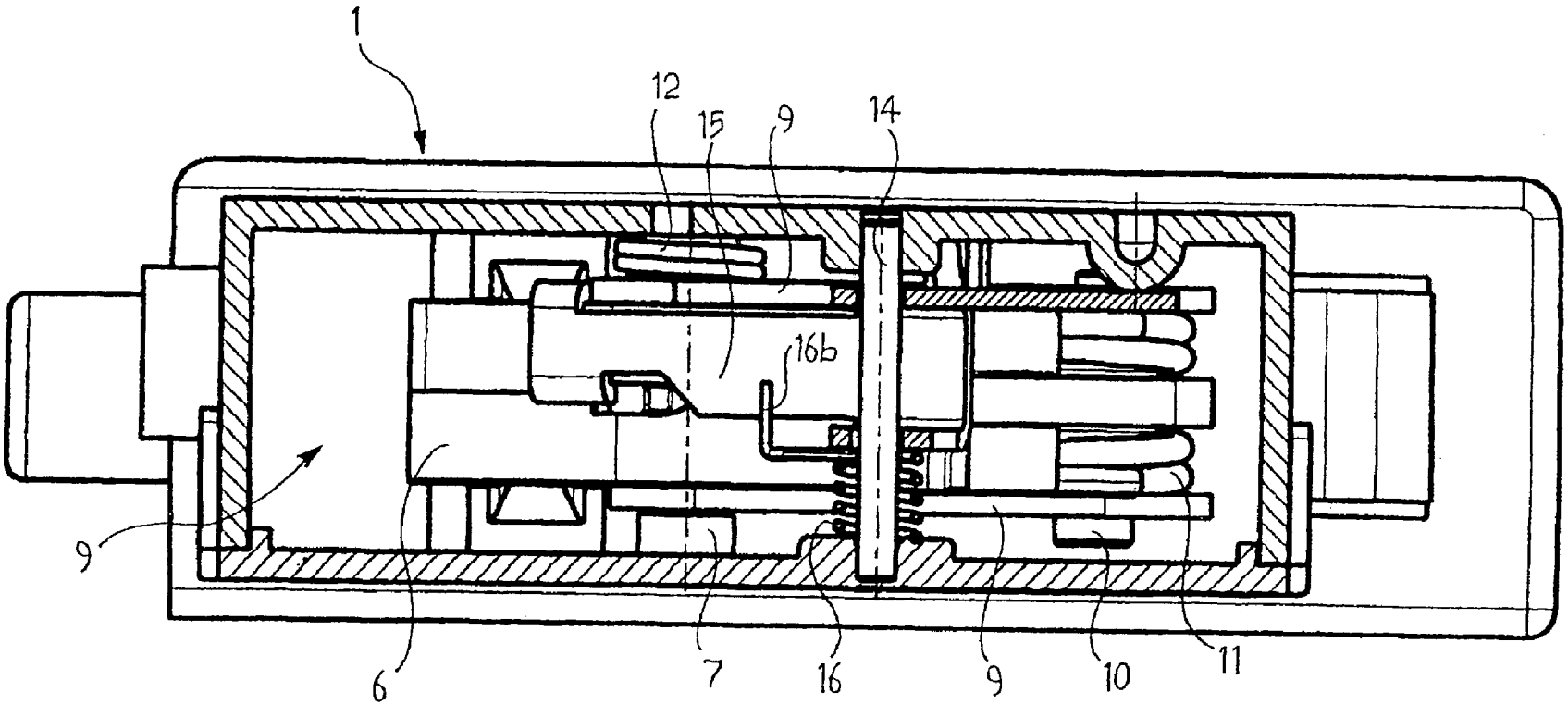
FIG. 4 is a sectional view taken on the line IV—IV of FIG. 1.

Associated with the cam member 6 is an auxiliary body 9 which embraces this cam member as better seen in FIGS. 2 and 3. The auxiliary body 9 is also rotatably mounted about the pin 7. Moreover, the auxiliary body 9 is articulated to the cam member 6 about a secondary axis which is movable with respect to the support structure 1, this axis being essentially represented by a pin indicated 10. As can be seen in particular from FIG. 1, the shape of the curvilinear slot 8 of the cam member 6 is essentially an arc of a circle centred on the axis of the pin 10.

A torsion spring 11 is disposed about the pin 10 and its end portions 11*a* and 11*b* react one against the cam member 6 and the other against the associated auxiliary body 9, tending to maintain them in the relative angular position shown in FIG. 1.

A further torsion spring 12 is disposed around the pin 7 and has an end 12*a* which reacts against a stop la of the support casing 1 (FIG. 1) and another end 12*b* which reacts against the auxiliary body 9 (FIGS. 2 and 3). The spring 12 tends to cause the body 9 and the cam member 6 to rotate about the stationary pin 7 in an anticlockwise sense as viewed in FIG. 1.

The cam member 6 has a recess or cavity 13 at its end, between two arms 6a and 6b.

The recess or cavity 13 can receive a transverse end part 2*a* of the hook 2 connected to the door 5.

With reference in particular to FIGS. 1 to 4, a further pin mounted in a stationary position in the support casing 1 is indicated 14. A pawl 15 is rotatably mounted about this pin.

The pins 7, 10 and 14 are essentially parallel to one another.

A torsion spring 16, disposed about the pin 14 has an end 16*a* which reacts against a stop 17 formed in support casing 1, and another end 16*b* which reacts against the pawl 15, tending to press it towards the cam member 6 and the associated auxiliary body 9.

As better seen in FIGS. 2 and 3, the pawl 15 has a pair of end teeth indicated 18 and 19. These teeth are essentially parallel, facing one another and spaced in a direction transverse the length of the pawl 15.

As will appear more clearly hereinbelow the tooth 18 is an exploration or feeler tooth intended to co-operate with the profile of the cam 6 which will be described hereinbelow.

The tooth 19, on the other hand, is a stop tooth, intended, in some operating conditions, to co-operate with a corresponding tooth 9*a* (FIG. 2) of the auxiliary body 9, to retain this latter in a predetermined angular position (FIG. 6) corresponding to closure of the door 5.

Figure 5:
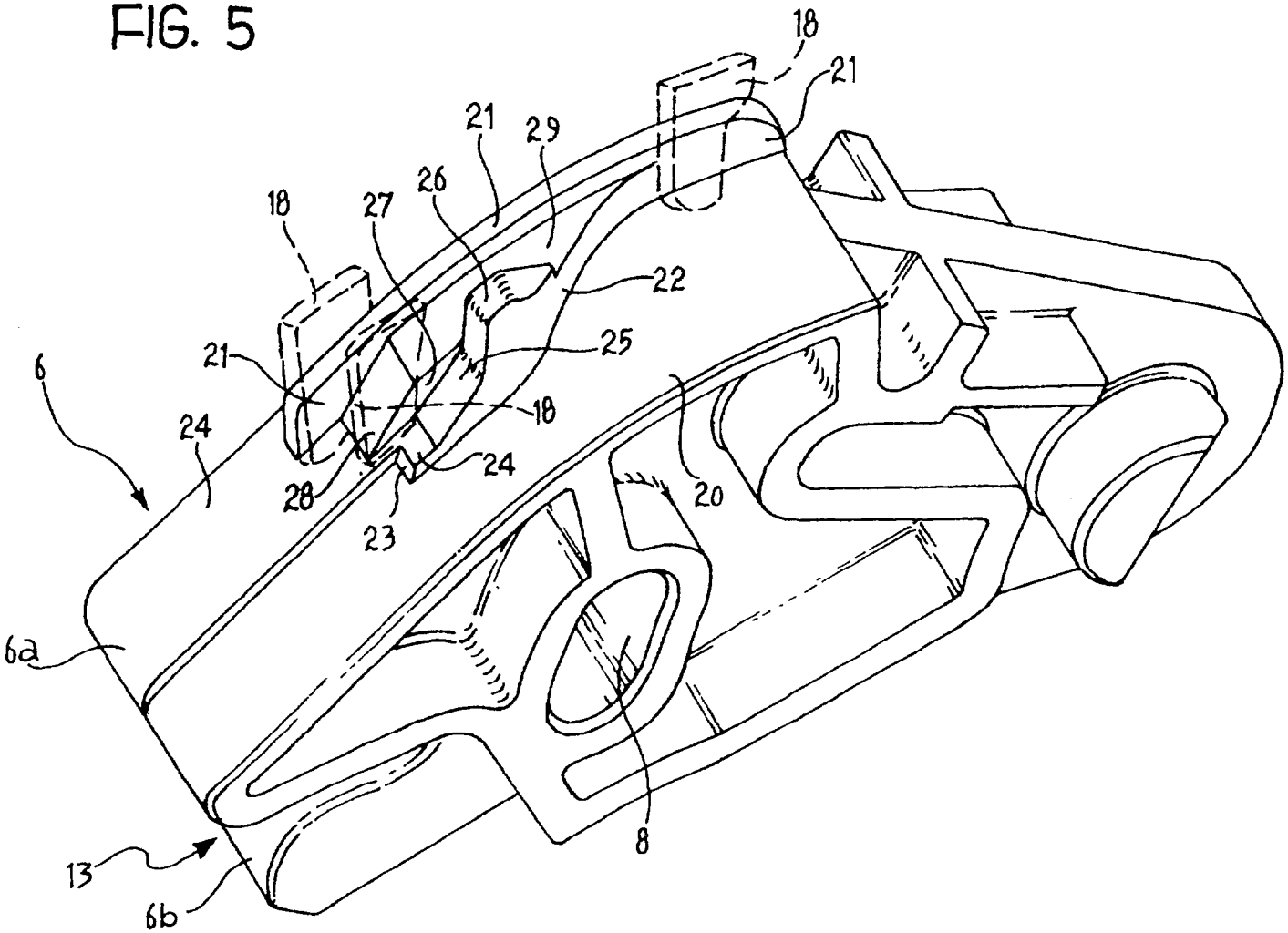
FIG. 5 is a perspective view, on an enlarged scale, of a rotary cam member of a device according to the invention.

With reference in particular to FIG. 5, the rotatable member 6 is provided at its top with a plurality of cam profiles intended to co-operate with the tooth 18 (here shown in broken outline in three different operating positions) of the pawl 15.

In particular, the upper part of the rotatable member 6 has a convex, arcuate, longitudinal sliding surface 20. On one side of the stop surface of the member 6 extends a longitudinal wall 21 essentially orthogonal to the sliding surface 20. From the wall 21 extends a control profile 22 of sinuous shape, which becomes progressively spaced from this wall, and which extends up to a small step 23 which marks a transition from the sliding surface 20 to a slightly elevated surface 24. From this surface 24 extends a first ascending ramp 25 which rises in the direction of a peak 26. A stop surface 27, essentially parallel to the wall 21, extends between one side of the ramp 25 and one side of the further ascending ramp 28 longitudinally offset with respect to the ramp 25. The ramp 28 lies between the stop surface 27 and one end of the wall 21. This wall has a greater height than the surface 29, which is reached from the top of the ramp 28.

With reference to FIGS. 2 and 3, the spring 16, as well as acting as a torsion spring, also acts as a thrust coil spring on one wing 15*a* of the pawl 15, thus pressing the whole pawl in the direction of the arrow F1 of FIG. 2 in such a way that the feeler tooth 18, in operation and depending on the angular position of the cam member 6, is thrust into contact with the wall 21 or with the profile 22, the stop wall 27, or the wall 21 again.

The door lock device described above operates substantially in the following manner.

In FIG. 1 the device is shown in the door-open condition with the hook 2 connected to the door 5, disengaged from the rotatable member 6. In this condition the cam member 6 and the associated auxiliary body 9, under the action of the springs 11 and 12, assume the relative angular positions illustrated in which the body 9 abuts against a stop 1*b* and the feeler tooth 18 of pawl 15 engages the end portion of the wall 21 in correspondence with the transversely wider part of the sliding track 20.

To close the door, this latter is pressed in such a way that the hook 2 enters into the cavity 13 of the cam member 6 causing rotation of this latter and of the auxiliary body 9 about the pin 7. During this rotation the feeler tooth 18 of the pawl 15 is displaced following the sinuous path of the control profile 22 of the cam member, at the end of which, under the thrust of the spring 16, it moves forward to the step 23, which rises to contact against the stop surface 27, again under the action of the spring 16. When the feeler tooth 18 has reached this position (FIG. 3) the associated locking tooth 19 engages the tooth 9*a* of the auxiliary body as is shown in FIG. 2, preventing the return rotation of this auxiliary body and the cam member 6. The door 5 is held in the closure position as is shown in FIG. 6.

In this condition it is possible to cause reopening of the door 5 by exerting on it a pressure from outside (opening in the so-called 'push-push' manner). The thrust exerted on the door 5 causes a clockwise rotation, as viewed in FIG. 6, of the cam member 6 and the associated auxiliary body 9 about the pin 7. Following this rotation the feeler tooth 18 of the pawl 15 leaves the stop surface 27 and, pressed transversely by the spring 16, comes into contact against the end of the wall 21 adjacent to the ramp 28. This lateral displacement of the pawl causes disengagement of the locking tooth 19 from the auxiliary body 9. This body 9, with the cam member 6 engaged by it, is then caused to rotate towards the opening position of the door by the action of the spring 12. During this rotation the feeler tooth 18 of the pawl 15 rises up the ramp 28 and slides on the surface 29 in contact with the top portion of the wall 21, until at the end of the surface 29 it falls back onto the sliding surface 20. The device is thus returned to the condition shown in FIG. 1 and the door is openable.

Figure 6:
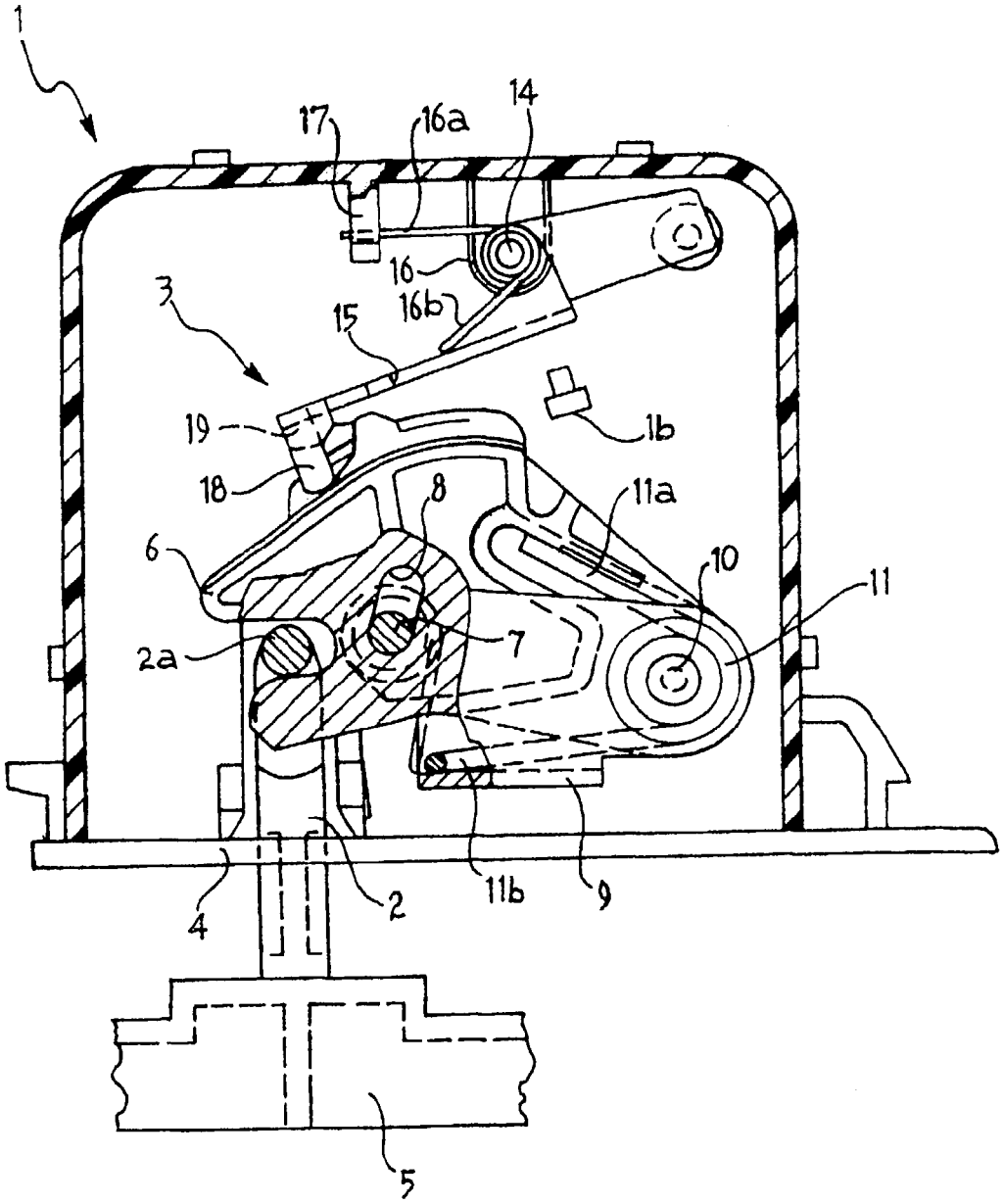
FIG. 6 is view similar to that shown in FIG. 1, and shows the door lock device in the door-closed condition.

When the door is retained in the closure position shown in FIG. 6, the device allows the door 5 to be opened by the effect of a thrust acting on it from within the machine. This function is useful, for example, to allow opening in an emergency by a child who may possibly have entered the machine and closed its door.

Figure 7:
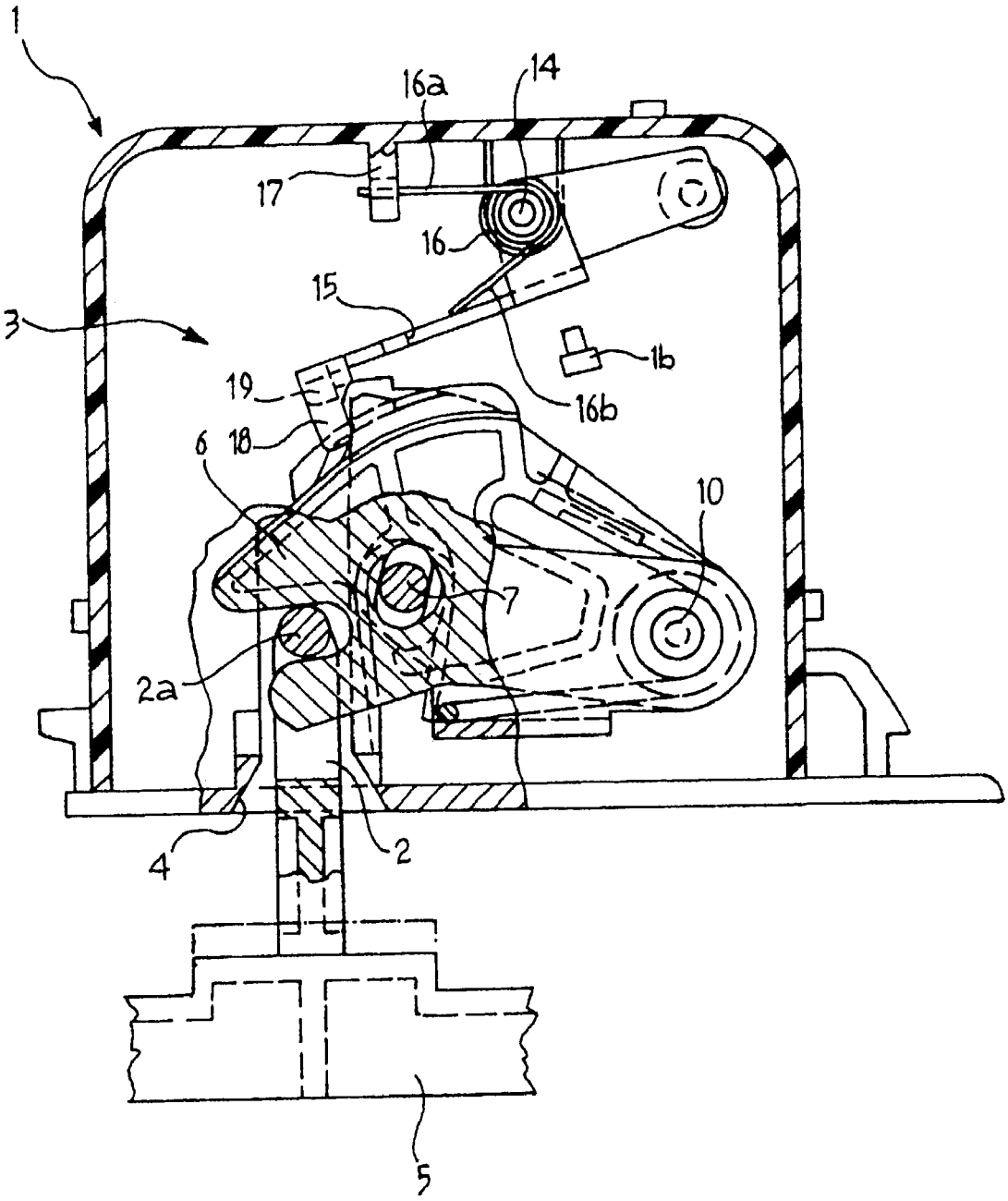
FIGS. 7 and 8 are views similar to those of FIGS. 1 and 6 and show the door lock device in two successive operating phases of emergency opening of the door.
Figure 8:
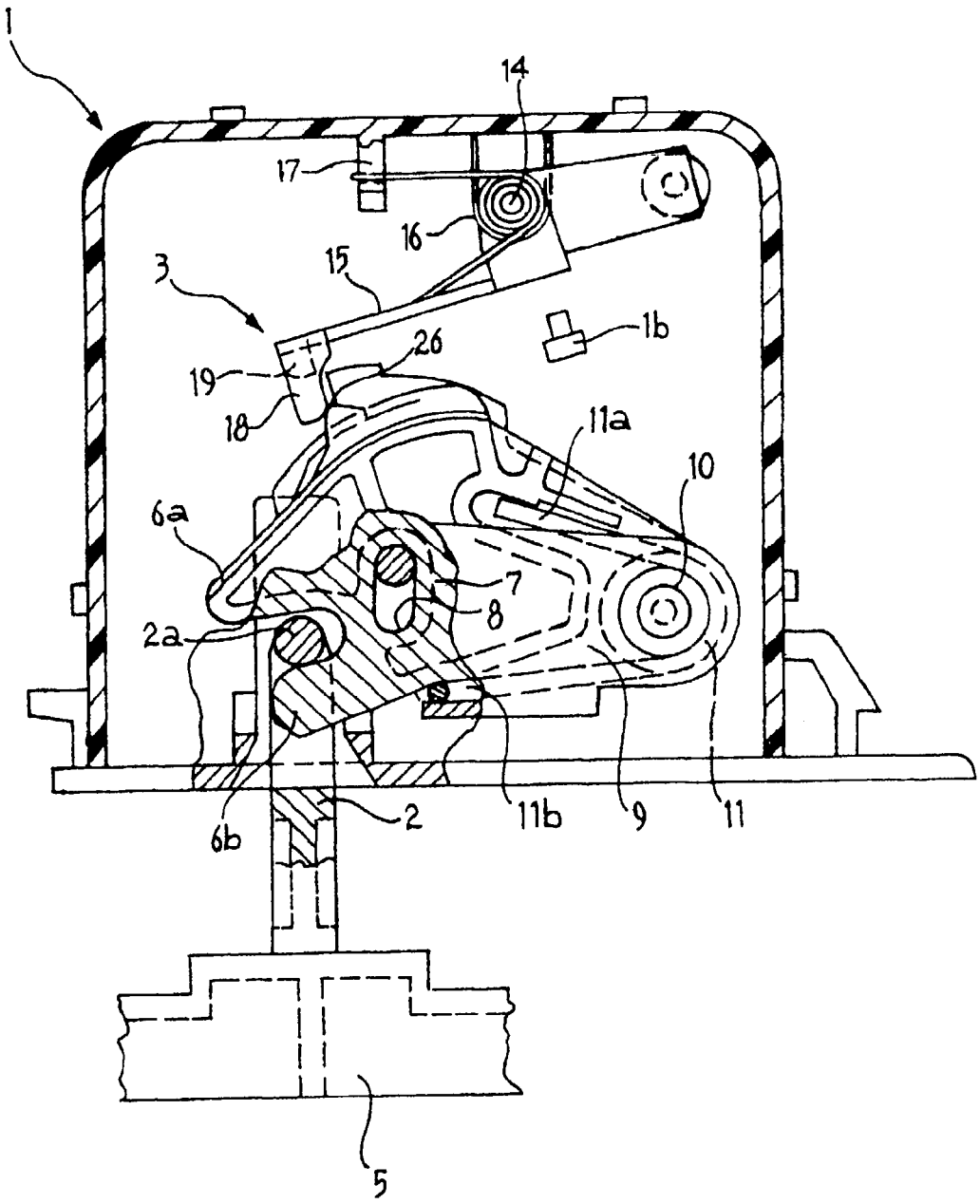

In the door-closed condition (FIG. 6) the feeler tooth 18 of the pawl 15 presses against the stop surface 27 adjacent the ramp 25. A force exerted on the hook 2 in the opening direction of the door 5 causes rotation of the cam member 6 about the pin 10. During this rotation (see the intermediate position shown in FIG. 7) the feeler tooth 18 of the pawl 15 slides on the ramp 25 (FIG. 5) and rises to the top of the projection 26 (FIG. 8). Consequently, the associated stop tooth 19 of the pawl 15 disengages itself from the auxiliary body 9. This body, no longer restrained, can now turn together with the cam member 6 into the angular position of FIG. 1 in which it allows disengagement of the hook 2 and opening of the door 5.

The mechanism is conveniently formed in such a way that, by choosing the width of the slot 8 of the cam member 6 and the position of the projection 26 in relation to the feeler tooth 18 of the pawl, there is a predetermined neutral stroke before release of the door from within the apparatus. This characteristic gives the device a certain operating stability and allows for compensation of possible dimensional variations (due for example to ageing) of the seal or seals associated with the door 5 with reference to the balanced door-closed position.

In a manner not illustrated in the drawings, the device may have an associated electric microswitch with an operating member which can be engaged, for example by the auxiliary body 9, when the device is in the door-closed position, for the purpose, for example, of generating a signal and/or providing an enabling signal allowing activation of the domestic electrical appliance.

Naturally, the principle of the invention remaining the same, the embodiments and details of construction can be widely varied with respect to what has been described and illustrated purely by way of non-limitative example, without by this departing from the ambit of the invention as defined in the annexed claims.

The invention claimed is:

1. A door lock device for domestic electric apparatus, in particular for washing machines and/or tumble dryers, comprising a hook (2) connected to the door (5), and a support structure in which is defined an aperture (4) for the introduction of the said hook (2), and in which are mounted:

a rotatable member (6) biased by a spring (12) and operable in a first position to retain the hook with the door (5) in the closure position, and in a second position to release this hook (2) permitting the door (5) to be opened;

a control device (14–16) including a pawl (15) by means of which the said rotatable member (6) can be held in the said first position;

the device being characterised by the fact that the said member (6) is mounted rotatably with clearance about a main axis (7) which is stationary with respect to the support structure (1) and is, moreover, articulated in a rotatable manner about a secondary axis (10), which is movable with respect to the said structure (1), to an auxiliary body (9) which is also rotatable about the main axis (7);

resilient means (11) being interposed between the rotatable member (6) and the said auxiliary body (9);

the pawl (15) being arranged to retain the auxiliary body (9) in a stationary position to hold the rotatable member (6) in the said first position;

the arrangement being such that if, when the door (5) is closed, a force in the opening direction of the door (5) is applied to the hook (2), the rotatable member (6) is initially free to turn against the action of the said resilient biasing means (11) with respect to the auxiliary body (9) to a position in which the said rotatable member (6) is able to release the auxiliary body (9) from the pawl (15, 19) and then to turn, together with the auxiliary body (9) and under the action of the said resilient means (11), towards the said second position.

2. A door lock device according to claim 1, in which the said member (6) is mounted rotatably about a stationary pin (7) which extends through a slot-like aperture (8) of the said rotatable member (6), the said aperture (8) having a shape which is essentially an arc of a circle centred on the said secondary axis (10).

3. A door lock device according to claim 1, in which the said control device (14–16) comprises a pawl (15) provided at one end with a feeler tooth (18) intended to co-operate with surfaces or profiles (20–29) of the said rotatable member (6) and a stop tooth (19) intended to co-operate with the auxiliary body (9).

4. A door lock according to claim 3, in which the pawl (15) is rotatably mounted about a pin (14) which is stationary with respect to the support structure (1), under the action of resilient biasing means (16) tending to maintain the feeler tooth (18) in engagement with the rotatable member (6) and to press the pawl (15) in the transverse direction.

5. A door lock device according to claim 4, characterised in that the said resilient biasing means comprise a single spring (16) operating as a torsion spring and as a coil spring.

6. A door lock device according to claim 4, characterised in that the rotatable member (6) is provided with control surfaces and profiles (21–29) operable together with the said resilient biasing means (16) to control the transverse position of the pawl (15).

* * * * *